US011316288B2

(12) United States Patent
Urbaniak et al.

(10) Patent No.: US 11,316,288 B2
(45) **Date of Patent: *Apr. 26, 2022**

(54) ELECTRICAL CONNECTOR WITH SLIDER OPERATED CLAMP SPRING ARM

(71) Applicant: APTIV TECHNOLOGIES LIMITED, St. Michael (BB)

(72) Inventors: Andreas Urbaniak, Muenster (DE); Thulasiraman Shanmugam, Chennai (IN); Vijay Babu Moorthy, Chennai (IN); Sathishkumar Venkatesan, Chennai (IN); Erik Michelsen, Trollasen (NO); Adrian Hanisch, Hamburg (DE)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 16/648,023

(22) PCT Filed: Sep. 3, 2018

(86) PCT No.: PCT/EP2018/073637

§ 371 (c)(1),
(2) Date: Mar. 17, 2020

(87) PCT Pub. No.: WO2019/057475

PCT Pub. Date: Mar. 28, 2019

(65) Prior Publication Data

US 2020/0259273 A1 Aug. 13, 2020

(30) Foreign Application Priority Data

Sep. 20, 2017 (EP) ..... 17192162

(51) Int. Cl.
*H01R 4/48* (2006.01)
*H01R 13/506* (2006.01)

(52) U.S. Cl.
CPC ..... *H01R 4/4845* (2013.01); *H01R 4/4836* (2013.01); *H01R 13/506* (2013.01)

(58) Field of Classification Search
CPC .. H01R 4/4845; H01R 4/4836; H01R 13/506; H01R 4/48; H01R 4/4818
(Continued)

(56) References Cited

U.S. PATENT DOCUMENTS 4,992,062 A 2/1991 Nakayama et al.
7,011,551 B2 3/2006 Johansen et al.
(Continued)

FOREIGN PATENT DOCUMENTS

CN 101325288 A 12/2008
DE 20 2011 104 318 U1 10/2012
(Continued)

OTHER PUBLICATIONS

International Search Report and Written Opinion of the International Searching Authority for International application No. PCT/EP2018/073637 dated Nov. 9, 2018.
(Continued)

*Primary Examiner* — Travis S Chambers
(74) *Attorney, Agent, or Firm* — Carlson, Gaskey & Olds, P.C.

(57) ABSTRACT

An electrical connector for receiving at least one electrical conductor comprises a housing, a bus bar arranged inside the housing, and at least one clamp arranged inside the housing. The clamp has a spring arm moveable relative to the bus bar between a connecting position and a disconnecting position. The spring arm cooperates with the bus bar to secure an electrical conductor to the bus bar when the spring arm is in the connecting position. The spring arm allows an end section of an electrical conductor to be inserted through an opening of the housing in the disconnecting position. At
(Continued)

least one slider extends into the housing and is moveable relative to the housing between a closed position and an open position. The slider includes at least one sliding guide cooperating with the spring arm such that a movement of the slider translates into a movement of the spring arm.

19 Claims, 16 Drawing Sheets

(58) Field of Classification Search
USPC ..... 439/816, 439, 441, 834–838
See application file for complete search history.

(56) References Cited

U.S. PATENT DOCUMENTS

| | | | | |
|---|---|---|---|---|
| 7,507,106 | B2 | 3/2009 | Keswani et al. | |
| 7,731,522 | B2 | 6/2010 | Keswani et al. | |
| 8,851,938 | B2 | 10/2014 | Taguchi et al. | |
| 9,478,874 | B2 * | 10/2016 | Stolze | H01R 11/09 |
| 9,543,700 | B2 * | 1/2017 | Kollmann | H01R 13/639 |
| 10,396,476 | B2 | 8/2019 | Stjepanovic et al. | |
| 10,505,295 | B2 * | 12/2019 | Moser | H01R 13/6275 |
| 10,686,262 | B2 | 6/2020 | Wu et al. | |
| 11,038,289 | B2 * | 6/2021 | Urbaniak | H01R 4/4818 |
| 2006/0286839 | A1 | 12/2006 | Bethurum et al. | |
| 2007/0066143 | A1 | 3/2007 | Lin et al. | |
| 2008/0311802 | A1 | 12/2008 | Keswani et al. | |
| 2009/0088028 | A1 | 4/2009 | Ngo et al. | |
| 2009/0104803 | A1 | 4/2009 | Bethurum et al. | |
| 2010/0267289 | A1 | 10/2010 | Urano | |
| 2011/0151720 | A1 | 6/2011 | Xie | |
| 2011/0207361 | A1 | 8/2011 | Heckert et al. | |
| 2015/0372401 | A1 | 12/2015 | Stolze | |
| 2015/0380838 | A1 | 12/2015 | Kollmann et al. | |
| 2016/0126644 | A1 | 5/2016 | Yamada | |

FOREIGN PATENT DOCUMENTS

| | | | | |
|---|---|---|---|---|
| DE | 10 2013 101 410 | A1 | 8/2014 | |
| DE | 10 2013 101 411 | A1 | 8/2014 | |
| DE | 10 2014 119 406 | A1 | 6/2016 | |
| DE | 102015100257 | A1 * | 6/2016 | H01R 4/4836 |
| JP | H06-215810 | A | 8/1994 | |

OTHER PUBLICATIONS

International Search Report and Written Opinion from the International Searching Authority for International application No. PCT/EP2018/073638 dated Nov. 9, 2018.

* cited by examiner

ELECTRICAL CONNECTOR WITH SLIDER OPERATED CLAMP SPRING ARM

CROSS REFERENCE TO RELATED APPLICATIONS

This application is the national stage application of PCT/EP2018/073637, filed Sep. 3, 2018, which claims priority to EP 17192162.0, dated Sep. 20, 2017.

The invention relates to an electrical connector for receiving at least one electrical conductor. The connector comprises a housing with at least one opening for inserting an electrical conductor, in particular an end section of an electrical conductor, into the housing. For connection purposes, a bus bar and at least one clamp are arranged inside the housing. The clamp comprises a spring arm being moveable relative to the bus bar. The spring arm can be pre-loaded towards the bus bar so that an electrical conductor inserted into a gap between the bus bar and the spring arm can be mechanically secured, i.e., clamped and thereby connected to the bus bar by means of the spring arm. For connecting two or more electrical conductors by means of the connector, one or more clamps can be arranged inside the housing of the connector, each clamp securing one or more of the conductors to the bus bar, thereby electrically connecting the conductors with each other. As the person skilled will understand, the clamp itself can participate in electrically connecting the conductors.

BACKGROUND

A general problem of the connector with the clamp being arranged inside the housing lies in the actuation of the spring arm. When no conductor is connected, the spring arm usually directly cooperates with the bus bar, wherein the free end of the spring bar rests firmly on the bus bar. For connecting a conductor, the spring arm needs to be lifted against a restoring force so that the conductor can be inserted into the clamp. Sometimes it is sufficient to push an end section of the conductor against the spring arm itself, wherein the spring arm is displaced in response and forming the necessary gap to insert the conductor into the clamp. However, this is not always possible. Especially light flexible or twisted conductors usually cannot be inserted into the clamp and exert the force necessary to displace the spring arm. This means that the user of the connector needs to manually position the spring arm at some distance away from the bus bar, wherein a suitable gap between the spring arm and the bus bar is formed. Then the electrical conductor can be inserted into the clamp. Afterwards, the spring arm can be released, wherein the spring arm secures the conductor on the bus bar. For removing the conductor from the clamp it is sometimes also necessary to lift the spring arm again so that the conductor is no longer secured to the bus bar. If the conductor is simply pulled away from the clamp without prior release of the spring arm some types of conductors can be damaged or break.

Connectors using a lever for moving the spring arm are known from the art. These connectors have disadvantages. By nature, any lever forms a hook for conductors, which is especially undesired in an electrical installation environment. A lever can be moved unintentionally, e.g. by a moving conductor, wherein a conductor secured in the clamp can be released and disconnected, thus leading to unsafe electrical conditions (e.g., malfunction, short circuit). Furthermore, there are mechanical disadvantages. For example, the lever needs special support in the housing.

Otherwise, the lever can be removed unintentionally from a mounting position or during actuation by a user, wherein the housing could be destroyed also. Connectors with levers are also difficult to build at compact size.

SUMMARY

An electrical connector according to an example embodiment comprises a housing, a bus bar arranged inside the housing, and at least one clamp arranged inside the housing. The at least one clamp comprises a spring arm moveable relative to the bus bar along a first axis between a connecting position and a disconnecting position. The spring arm cooperates with the bus bar to secure an electrical conductor to the bus bar when the spring arm is in the connecting position. The spring arm is positioned at a predetermined distance away from the bus bar when the spring arm is in the disconnecting position, thereby allowing an electrical conductor to be inserted through an opening of the housing into a gap between the spring arm and the bus bar or to be removed therefrom. The connector further comprises at least one slider extending into the housing and being moveable relative to the housing along a second axis between a closed position and an open position. The slider includes two opposite sliding guides cooperating with a convex support surface of the spring arm such that a movement of the slider translates into a movement of the spring arm along the first axis. The sliding guides are formed at two opposite side arms of the slider, said side arms extending parallel to the second axis.

In an example embodiment, the slider is manually operable, i.e. without using special tools, from outside the housing. An advantage of using a slider over other actuating means, i.e. levers, is that the slider is moveable along an axis, which means that the slider is moveable along a linear, i.e. axial, trajectory. The disadvantages of curved trajectories, such as those associated with levers, are thus not present in the connector according to the invention. Consequently, the slider does not form a hook for conductors or the like which would be suitable to move the slider unintentionally.

Another advantage of the slider lies in the translation of its axial, i.e. linear movement to the axial movement of the spring arm. In particular, the sliding guide can be configured to adjust the degree of deflection of the spring arm relative to the bus bar. The transmission of the force necessary to move the spring arm can be proportional to the position of the slider. This allows the user to better control the position of the spring arm, which is usually not possible with the same accuracy when using a lever.

The sliding guide can be adapted to certain desired properties of the connector. A desirable property of the connector can be that the force necessary to move the slider is generally constant, which simplifies the process of connecting a conductor. Another desirable property of the connector can be that the position of the spring is linear with the position of the slider.

The connecting position of the spring arm comprises any position in which the spring arm cooperates with the bus bar. The spring arm can either directly cooperate with the bus bar, which is usually the case when no conductor is inserted into the clamp. However, the spring arm can also indirectly cooperate with the bus bar, in particular when a conductor is clamped between the spring arm and the bus bar, thereby securing the conductor to the bus bar. In contrast, the disconnecting position is the position in which the spring arm is held at a distance away from the bus bar without cooperating with a conductor.

In an example embodiment, the housing comprises a plastic material. The plastic material forms an electrically insulating protection around the clamp and the bus bar. For this reason, the housing can consist of a plastic material only. The slider preferably comprises a plastic material, in particular only a plastic material. In contrast, the bus bar and the clamp preferably comprise an (electrically conducting) metal. Preferably, they consist only of a metal. The bus bar preferably comprises copper. The clamp preferably comprises a steel, in particular a stainless steel.

Advantageous embodiments of the invention are specified in the dependent claims, the description and the drawings.

According to an example embodiment, the spring arm comprises a free end bent towards the bus bar, in particular wherein the free end comprises a contact edge facing the bus bar.

In an example embodiment, the spring arm comprises at least one lateral tongue bent away from the bus bar, thereby forming a convex support surface for cooperation with the sliding guide. In particular, the spring arm can comprise two opposite lateral tongues cooperating with two lateral sliding guides of the slider. The term "lateral" indicates a direction parallel to the second axis and outside of a centre of the clamp. In this way, a lateral tongue is arranged on a side of the spring arm that does not obstruct a conductor inserted into the clamp. So the conductor does not interfere with the tongue of the spring arm or with the sliding guide.

According to another embodiment, the spring arm is in the connecting position when the slider is in the closed position, and the spring arm is in the disconnecting position when the slider is in the open position. In particular, the slider can be fully accommodated in the housing and/or can be substantially flush with the housing when the slider is in the closed position. This leads to greater safety since there is a minimum risk that the slider moves out of the closed position unintentionally.

The housing can comprise a reception for the slider, wherein the reception is preferably configured to guide the slider along the first axis. In other words, the slider can be moveable relative to the housing like a drawer.

According to another embodiment, the first axis and the second axis are substantially perpendicular to each other. This allows for good transmission properties with respect to the force necessary to move the slider. The user can thus actuate, i.e. operate the slider with relatively low effort.

According to another embodiment, the housing includes a first outer side and an opposite second outer side, the first outer side and the second outer side both being substantially parallel to the second axis. In particular, the first outer side comprises an opening for inserting the electrical conductor into the housing, wherein the slider extends into the housing through the second outer side. The slider is thus operable from the opposite side of the opening. This can greatly simplify the process of connecting an electrical conductor and enhances usability.

The connector can comprise at least one first locking member for securing the slider in the closed position relative to the housing. In this way, the slider can latch to the housing (snap-fit) when being in the closed position. This minimizes the risk of unintentional movement of the slider and can provide tactile feedback to the user.

The connector can further comprise at least one second locking member for securing the slider in the open position relative to the housing. The second locking member can prevent the slider from being removed from the housing and inform the user via tactile feedback when the open position is reached.

The first and second locking members can be identical or different. They can comprise at least one recess formed at an outer side of the slider and facing an inner side of the housing, wherein this inner side comprises at least one projection. The recess and the projection preferably engage when the slider is in the closed and/or open position relative to the housing. As the skilled person will understand, other, additional or modified, means of mechanical locking or latching can be provided. For example, an opening can be provided instead of a recess.

For simplifying actuation (i.e. operation) of the slider the slider can comprise an operating portion with at least two ridges arranged on opposite sides of the operating portion, wherein each of the two ridges projects outwardly away from the connector and extends substantially perpendicular to the second axis. The ridges can be formed by ribs and/or edges.

The operating portion of the slider can further comprise a support surface extending substantially parallel to the second axis, in particular perpendicular to the plane defined by the first and second axes, wherein the support surface forms a first outer side of the connector, in particular of the housing, and wherein one of the ridges is arranged adjacent to the support surface. In particular, the surface can simplify opening of the slider. For example, a thumb of the user can apply an opening force to the slider against the ridge of the operating portion while being supported by the support surface of the operating portion. The support surface can also enhance visibility of the position of the slider relative to the housing. The slider can include further support surfaces extending preferably parallel to the second axis. The slider can for example comprise two opposite support surfaces extending preferably parallel to the second axis.

For simplifying moving the slider from the open position into the closed position the operating portion can comprise a press surface extending substantially perpendicular to the first axis, wherein the press surface forms a second outer side of the connector, in particular of the housing. The slider can thus be conveniently pushed into the closed position, e.g. by means of a thumb of the user. The press surface is preferably arranged on a narrow side of the connector, in particular of the housing. The press surface can also act as a support surface while moving the slider from the closed position into the open position.

In an example embodiment, the press surface includes at least one recess or opening, preferably at least two recesses or openings. This helps avoiding a finger of the user slipping away from the press surface while exerting a force on the press surface. Several recesses or openings of the press surface can have different sizes. They can be generally configured to prevent slipping of a finger of the user while moving the slider from the open position into the closed position. For this reason, the press surface can be rough and can comprise areas of different depths. Additionally or alternatively, the press surface can have a concave shape.

The operating portion can be flush with the housing when the slider is in the closed position. This further improves usability of the connector and minimizes the risk of unintentional movement of the slider in an installation environment.

The housing of the connector can have a substantially rectangular outer shape. The connector can thus be handled conveniently and allows for advantageous fitting in an installation environment.

According to another embodiment, the housing of the connector comprises at least two outer recesses arranged on opposite sides of the housing, respectively, in particular wherein the opposite sides are narrow sides of the housing. The connector can thus be handled conveniently and with good grip, wherein the user can safely hold the connector with two fingers only. Preferably, the at least two recesses are disposed adjacent to an opening for inserting the conductor into the housing, wherein insertion of the conductor into the housing is simplified. The at least two recesses can extend substantially parallel to the second axis, i.e., the preferable direction of insertion of the conductor into the housing.

According to another embodiment, at least a portion of the housing comprises a transparent material, wherein inner portions adjacent to the transparent material become visible from outside the housing. The housing can be formed of a transparent material. In contrast, at least a portion of the slider can comprise an opaque material having a signalling colour, e.g., red. The position of the slider can thus be better monitored, whereby usability is improved.

According to another embodiment, the housing comprises at least one control window arranged such that a position of an end section of an electrical conductor inserted into the housing is visible from outside the housing. The user can thus make sure without turning the connector and looking into the opening whether the electrical conductor inserted into the housing is in a position suitable for connecting or not.

The housing can comprise an outer housing element and an inner housing element, wherein the inner housing element is arranged inside the outer housing element, and wherein the at least one clamp and/or the bus bar are secured in the housing by means of the inner housing element. The housing can be modular with at least two housing elements. Securing the clamp and/or the bus bar by means of an inner housing element separate from the outer housing element has the advantage that only a very low degree of mechanical stress is exerted on the outer housing element.

The inner housing element can be latched to the outer housing element, e.g., by means of a snap-fit connection. The inner housing element can be caught in the outer housing element. In addition, the bus bar and/or the clamp can be caught inside the outer housing element and/or inside the inner housing element.

According to another embodiment, the at least one clamp is directly mounted to the bus bar. The term "directly mounted" means that at least a mechanical connection is formed without any intermediate parts such as adaptors which are suitable to negatively influence the positional relationship between the bus bar and the clamp. In particular, the clamp is mechanically connected to the bus bar by means of an integral section of the clamp. The bus bar and the clamp are preferably mechanically self-contained.

The sliding guide can comprise a ramp section adapted such that the force exerted on the spring arm is approximately linear with respect to the position of the slider relative to the housing. This leads to better control of the position of the spring arm. The sliding guide can comprise other characteristics for improving positioning of the spring arm.

The connector can comprise more than one clamp mounted to the bus bar, wherein each clamp can define a connection terminal for an electrical conductor. The clamps can be mounted adjacent to each other. It is also possible that the connector comprises more than one bus bar, wherein clamps associated with a defined electrical potential are mounted to corresponding bus bars.

The connector is configured to connect all types of electrical conductors, i.e., rigid cables, twisted cables, stranded cables and stranded flexible cables, wherein the cross section area of the cables can be for example between 0.13 and 4 $mm^2$.

BRIEF DESCRIPTION OF DRAWINGS

The invention is described further in the following by means of exemplary embodiments shown in the enclosed drawings in which.

DETAILED DESCRIPTION

In the following, identical or similar features will be identified by the same reference signs.

Figure 1:
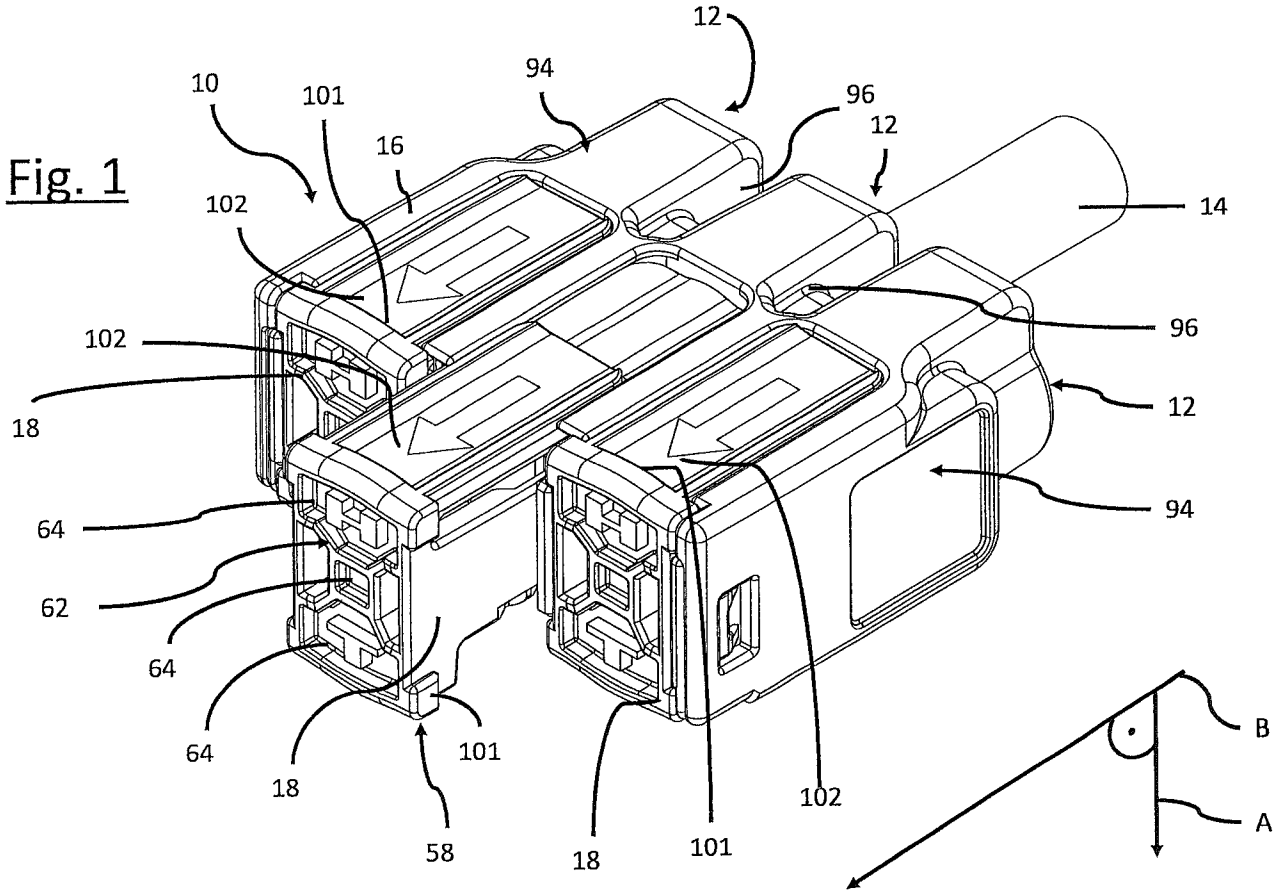
FIG. 1 shows a perspective view of an electrical connector with three connection terminals.
Figure 13:
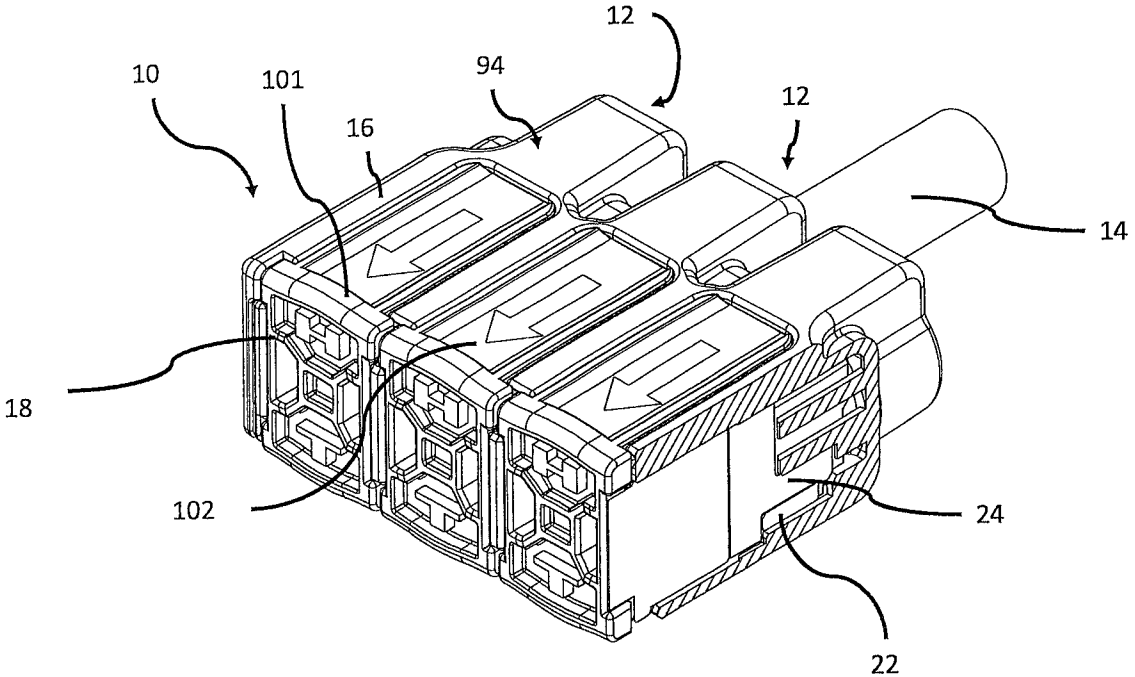
FIG. 13 shows a cross-sectional perspective view of the connector of FIG. 1.

An electrical connector 10 having three connection terminals 12 is shown in FIG. 1, wherein the perspective view is directed on a top side of the connector 10. An electrical conductor 14 is received in the connector 10 and inserted to a middle terminal 12. FIG. 13 is a perspective cross-sectional view of the connector of FIG. 1, wherein the cross-sectional plane is substantially parallel to the conductor 14. The connector 10 comprises an outer housing element 16 and a bus bar 22 arranged inside the outer housing element 16 (cf. FIG. 13). For each terminal 12, a clamp 24 is arranged inside the outer housing element 16 and directly mounted to the bus bar 22, as will be explained further. The outer housing element 16 has a substantially rectangular shape that substantially defines the outer shape of the connector 10. The outer housing element 16 preferably comprises a transparent material so that the interior of the connector 10, i.e., the clamps 24 and the bus bar 22 (cf. FIG. 13) can be seen from outside the outer housing element 16.

For each terminal 12, an associated slider 18 extends into the outer housing element 16. Each slider 18 is moveable independently from each other relative to the outer housing element 16 along a second axis B between a closed position and an open position, as will be explained further.

Figure 2:
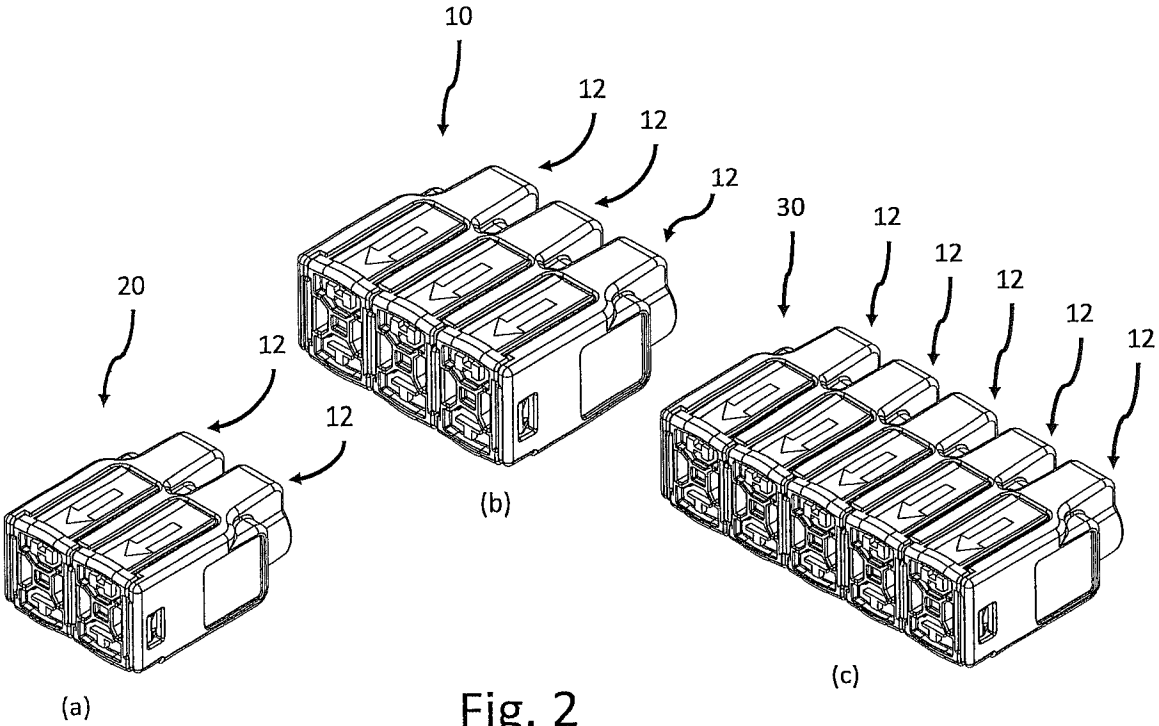
FIGS. 2*a*-2*c* show perspective views of electrical connectors with two (FIG. 2*a*), three (FIG. 2*b*), and five (FIG. 2*c*) connection terminals.

FIG. 2*b* shows the connector 10 of FIG. 1 in a different perspective view. In a comparison, FIG. 2*a* shows a connector 20 having two terminals 12. FIG. 2*c* shows a connector 30 having five terminals 12.

Figure 3:
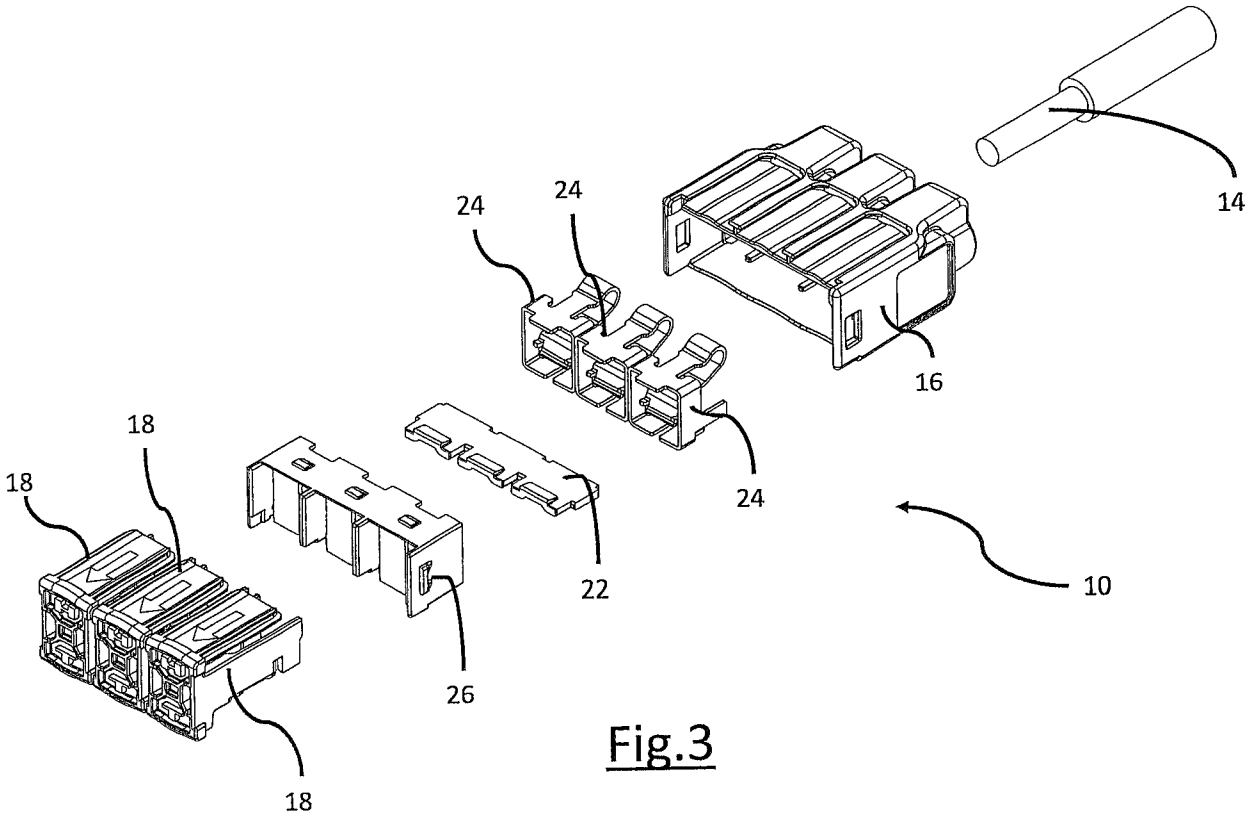
FIG. 3 shows a perspective explosion view of the electrical connector of FIG. 1.

FIG. 3 shows a perspective explosion view of the electrical connector 10 of FIG. 1. In addition to the bus bar 22 and the clamps 24, an inner housing element 26 is provided to be arranged inside the outer housing element 16.

FIGS. 4*a* to 4*j* show perspective views illustrating an assembly of the electrical connector 10 of FIG. 1. Before explaining the assembly in detail, the clamp 24 and the bus bar 22 are described in detail with reference to FIGS. 5*a*, 5*b*, 6*a*, 6*b*, and 6*c*.

Figure 5:
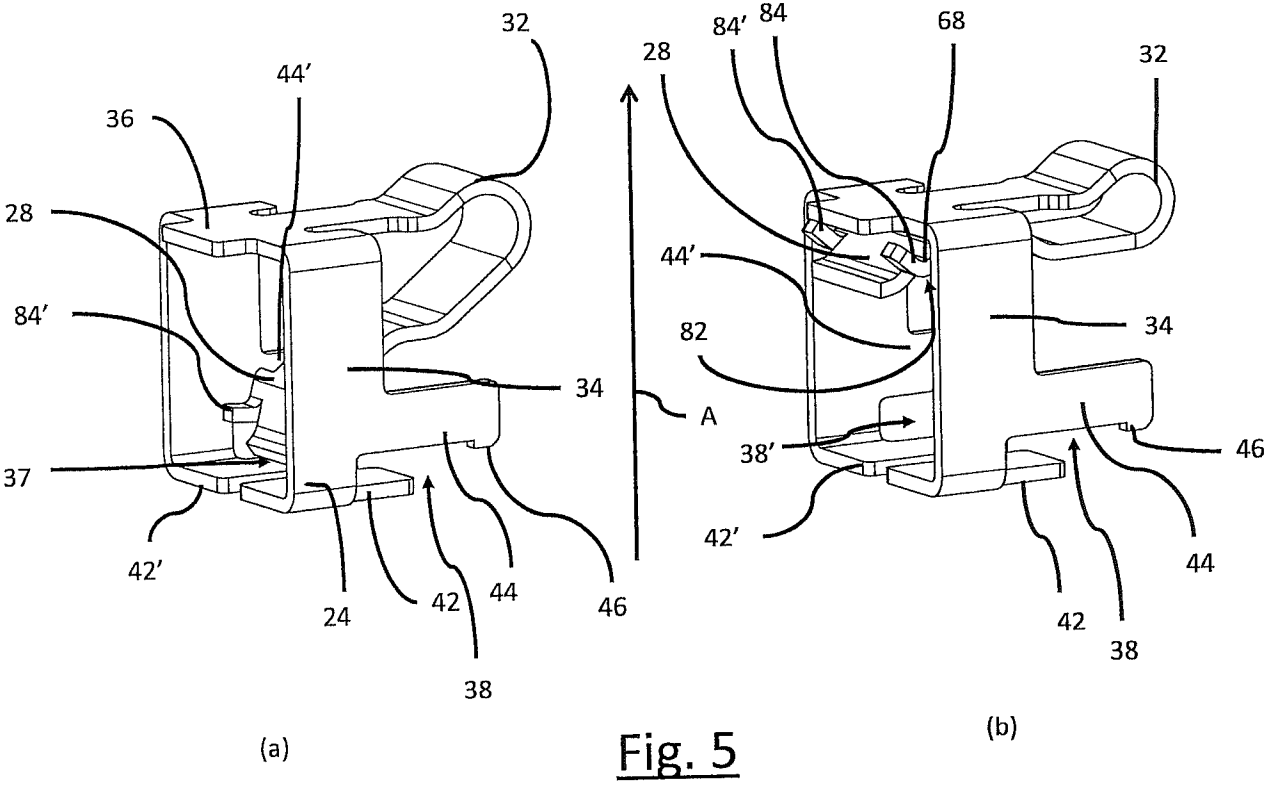
FIGS. 5*a*, 5*b* show perspective views of a clamp of an electrical connector with a spring arm of the clamp in a connecting position (FIG. 5*a*) and in a disconnecting position (FIG. 5*b*)

The clamp 24 comprises a spring arm 28 moveable along a first axis A between a connecting position and a disconnecting position. In FIG. 5*a*, the spring arm 28 is in a connecting position. In FIG. 5*b*, the spring arm 28 is in a disconnecting position. The movement of the spring arm 28 can be substantially limited along the first axis A, i.e. the spring arm 28 is moveable along the first axis A. However, the movement of the spring arm 28 is not necessarily strictly linear but can follow a curved trajectory.

The spring arm 28 preferably comprises a curved and resilient base portion 32 which is integrally connected to a frame portion 34 that is substantially U-shaped. The spring arm 28 preferably further comprises an extension portion 36 which is integrally connected to the frame portion 34 opposite from the base portion 32. The spring arm 28 preferably further comprises a contact edge 37 extending perpendicular to the first axis A.

Figure 6:
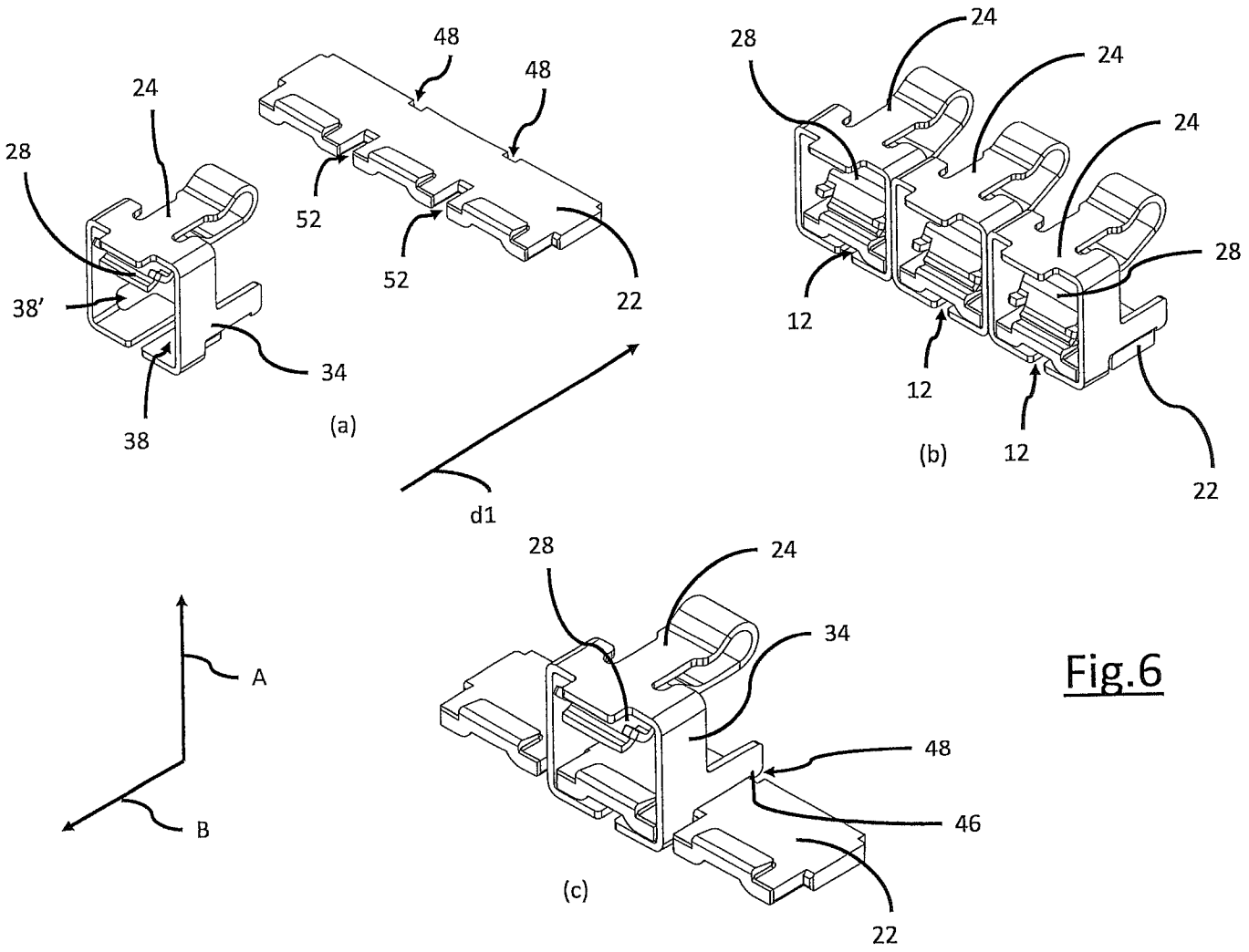
FIGS. 6*a*-6*c* show perspective views illustrating a mounting of three clamps to a bus bar for the connector of FIG. 1.
Figure 8:
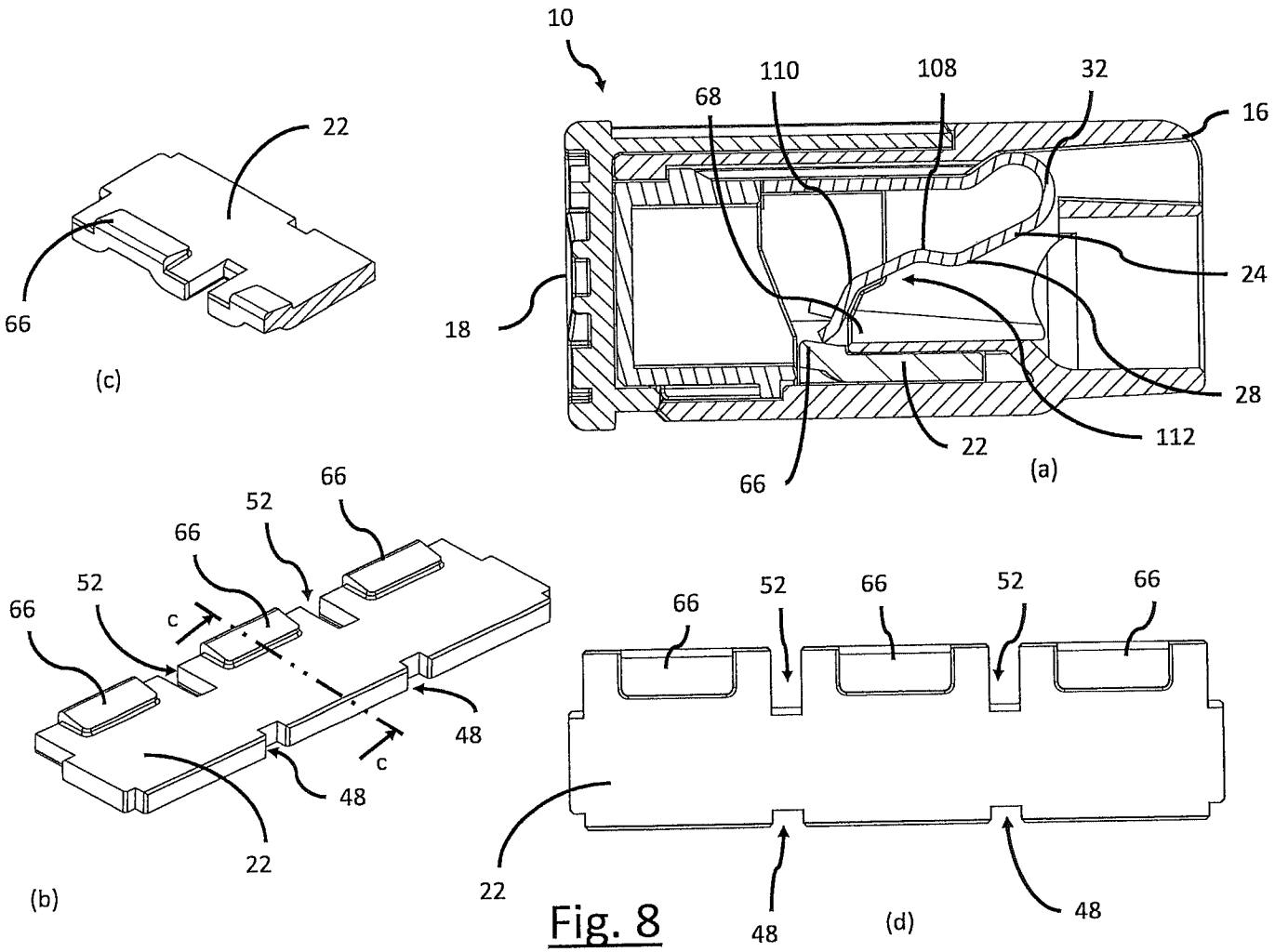
FIG. 8*a* shows a cross-sectional side view of the electrical connector of FIG. 1.
FIG. 8*b* shows a perspective view of a bus bar of the electrical connector of FIG. 1.
FIG. 8*c* shows a perspective cross-sectional view of the bus bar of FIG. 8*b;*
FIG. 8*d* shows a top view of the bus bar of FIG. 8*b;*

The clamp 24 preferably comprises two integral mounting sections 38, 38' arranged on two opposite sides of the spring arm 28. In the embodiment of FIGS. 5*a* and 5*b*, the two opposite sides are lateral sides of the spring arm 28, wherein the mounting sections 38, 38' are integral with the frame portion 34 and preferably generally identical. Each mounting section 38, 38' is formed by a support arm 42, 42' and a locking arm 44, 44', all preferably extending substantially parallel to the second axis B. The bus bar 22 extends between the support arm 42, 42' and the locking arm 44, 44' when the clamp 24 is mounted to the bus bar 22, as indicated in FIG. 6*c*. In this way, the clamp 24 grasps the bus bar 22 at two distant points. The spring arm 28 is preferably arranged above the mounting sections 38, 38' so that the spring arm 28 exerts a force on the bus bar 22 against the support arms 42, 42' of the mounting sections 38, 38' when the spring arm 28 is in the connecting position, as shown in FIG. 8*a*. Each locking arm 44, 44' comprises a projection 46 which engages behind the bus bar 22 when the clamp 24 is mounted to the bus bar 22, as shown for example in FIG. 6*c*. The projection 46 is preferably adapted for a snap-fit connection between the bus bar 22 and the clamp 24.

Starting from the situation shown in FIG. 6*a*, the clamp 24 is directly mounted to the bus bar 22 by introducing the bus bar 22 into the mounting sections 38, 38' until it is latched to the clamp 24, wherein the bus bar 22 is clamped in the mounting sections 38, 38', as shown in FIG. 6*c*. In the mounted condition, the projections 46 engage with recesses 48 formed on a narrow side of the bus bar 22. On the opposite narrow side of the bus bar 22, the frame portion 34 of the clamp 24 engages with two further recesses 52. The recesses 48, 52 of the bus bar 22 define mounting positions for the clamp 24. When mounted to the bus bar 22, the clamp 24 is preferably partially flush with the bus bar 22 with respect to one or all narrow sides of the bus bar 22.

The first axis A and the second axis B are preferably perpendicular to each other when the clamp 24 is mounted to the bus bar 22. The clamp 24 is mounted to the bus bar 22 in a first direction dl preferably substantially parallel to the second axis B, wherein the spring arm 28 can exert a force on the bus bar 22 in the first direction dl when the spring arm 28 is in the connecting position (FIG. 6*a*). The spring arm 28 can be displaced by the bus bar 22 during mounting. In another embodiment (not shown), the clamp 24 is mounted to the bus bar 22 in a second direction which can be substantially opposite to the direction in which the spring arm 28 can exert a force on the bus bar 22, i.e. the first direction dl. In the latter case, it would be effectively impossible that the bus bar 22 is dismounted due to a force exerted onto the bus bar 22 by the spring arm 28. During mounting the clamp 24 to the bus bar 22, the spring arm 28 is preferably held in the disconnecting position as shown in FIG. 6*a* and FIG. 6*c*. It is, however, also possible to let the spring arm 28 move away in response to the bus bar 22 during mounting.

FIG. 6*b* shows the bus bar 22 of FIGS. 6*a* and 6*c* with three clamps 24 mounted adjacently to the bus bar 22, thereby partially forming three terminals 12 of the connector 10 of FIG. 1. Each clamp 24 is mounted to the bus bar 22 in the same way.

Figure 4:
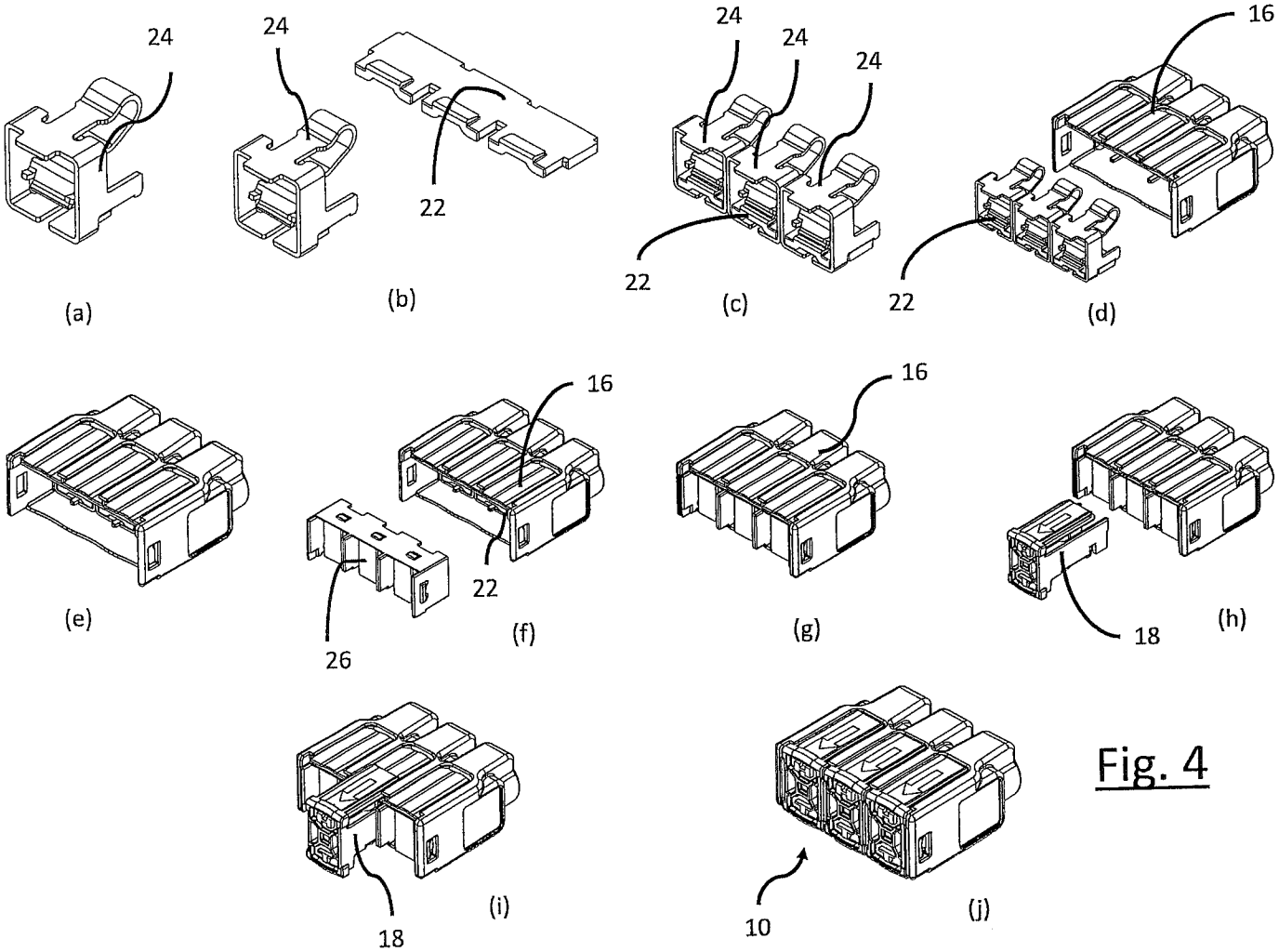
FIGS. 4*a*-4*j* show perspective views illustrating an assembly of the electrical connector of FIG. 1.

Coming back to FIGS. 4*a* to 4*j*, FIGS. 4*a* to 4*c* illustrates mounting of three clamps 24 to the bus bar 22, as explained above. The bus bar 22 is then introduced into the outer housing element 16 (FIG. 4*d*) and arranged inside the outer housing element 16 in the position shown in FIG. 4*e*. Afterwards, the inner housing element 26 is introduced into the outer housing element 16 (FIG. 4*f*) until it latches to the outer housing element 16 (FIG. 4*g*). Sliders 18 are introduced into the outer housing element 16 thereafter (FIGS. 4*h* to 4*j*), which finally results in the assembled connector 10 of FIG. 1 (FIG. 4*j*).

Figure 7:
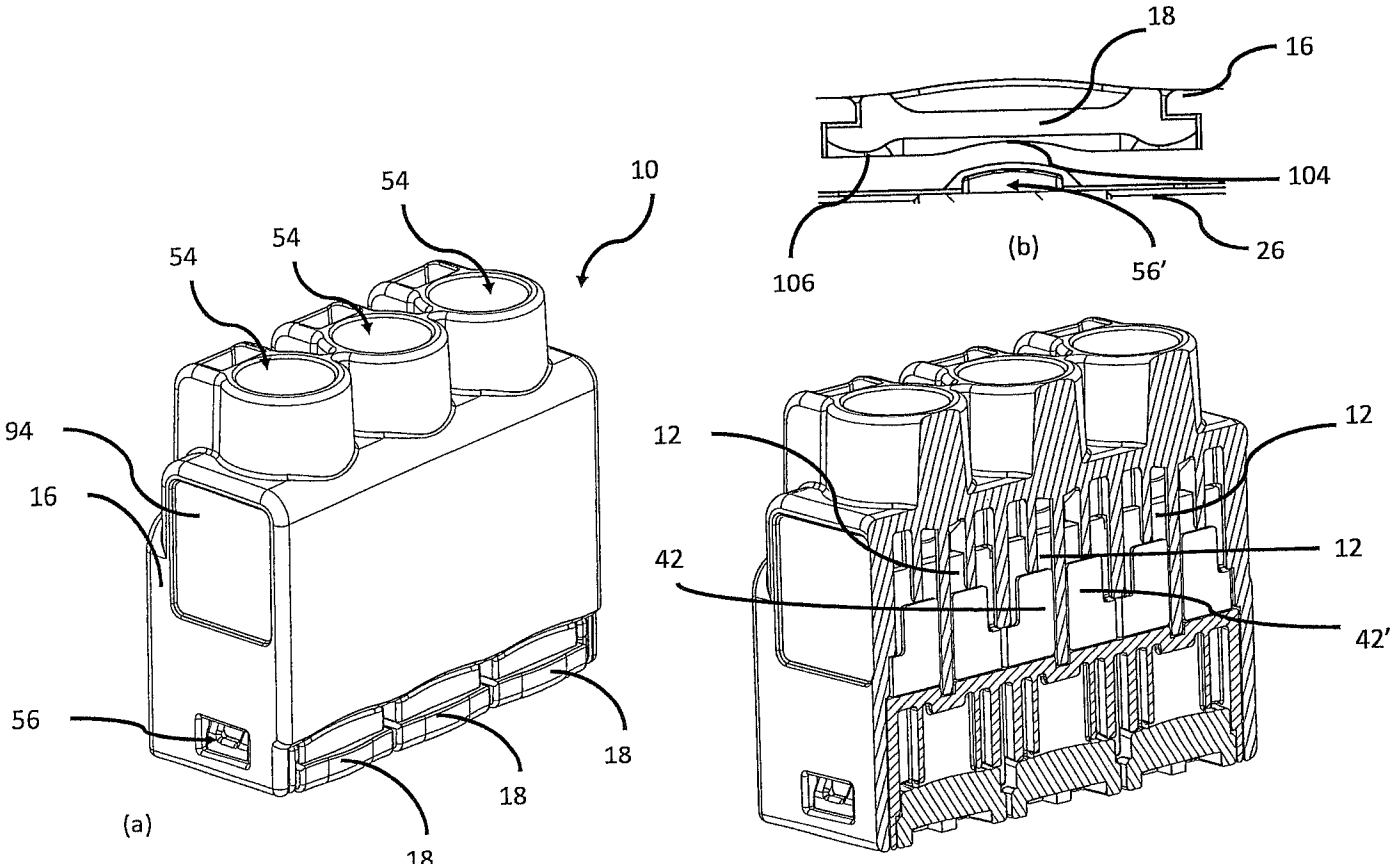
FIG. 7*a* shows a perspective view of the electrical connector of FIG. 1.
FIG. 7*b* shows a cross-sectional view of a slider and an adjacent portion of the housing of the electrical connector of FIG. 1.
FIG. 7*c* shows a cross-sectional perspective view of the electrical connector of FIG. 7*a;*

FIG. 7*a* shows a perspective view of the electrical connector 10 of FIG. 1 with the perspective view on a bottom side of the connector 10. As already mentioned above, the outer housing element 16 preferably comprises a transparent material so that the clamps 24 and the bus bar 22 can be seen from outside the outer housing element 16. This aspect cannot be seen in FIG. 7*a*. However, FIG. 7*c* shows the connector 10 of FIG. 7*a* along a cross-section through the connector 10, wherein the cross-sectional plane is indicated by crosshatched areas. Each terminal 12 is associated with an opening 54 in the outer housing element 16 for introducing an electrical conductor 12 into a corresponding clamp 24 of the terminal 12. As can also be seen in FIG. 7*a*, the outer housing element 16 comprises at least one further opening 56 for latching the inner housing element 26 to the outer housing element 16, wherein the bus bar 22 with the mounted clamps 24 is secured in the outer housing element 16 between the sliders 18 and the openings 54. The bus bar 22 with the clamps 24 is preferably received in the inner housing element 26.

The openings 54 are circular and are easily visible for a user due to the substantially circular shape of the adjacent portion of the outer housing element 16, i.e. a portion of the outer housing element 16 has a shape that corresponds to the shape of the openings 54 and the circular cross-section of the conductor 14, 14' to be inserted. The openings 54 can thus provide good mechanical support for the inserted conductor 14, 14'. Furthermore, the number of available terminals 12 can intuitively be recognized by a user.

Figure 10:
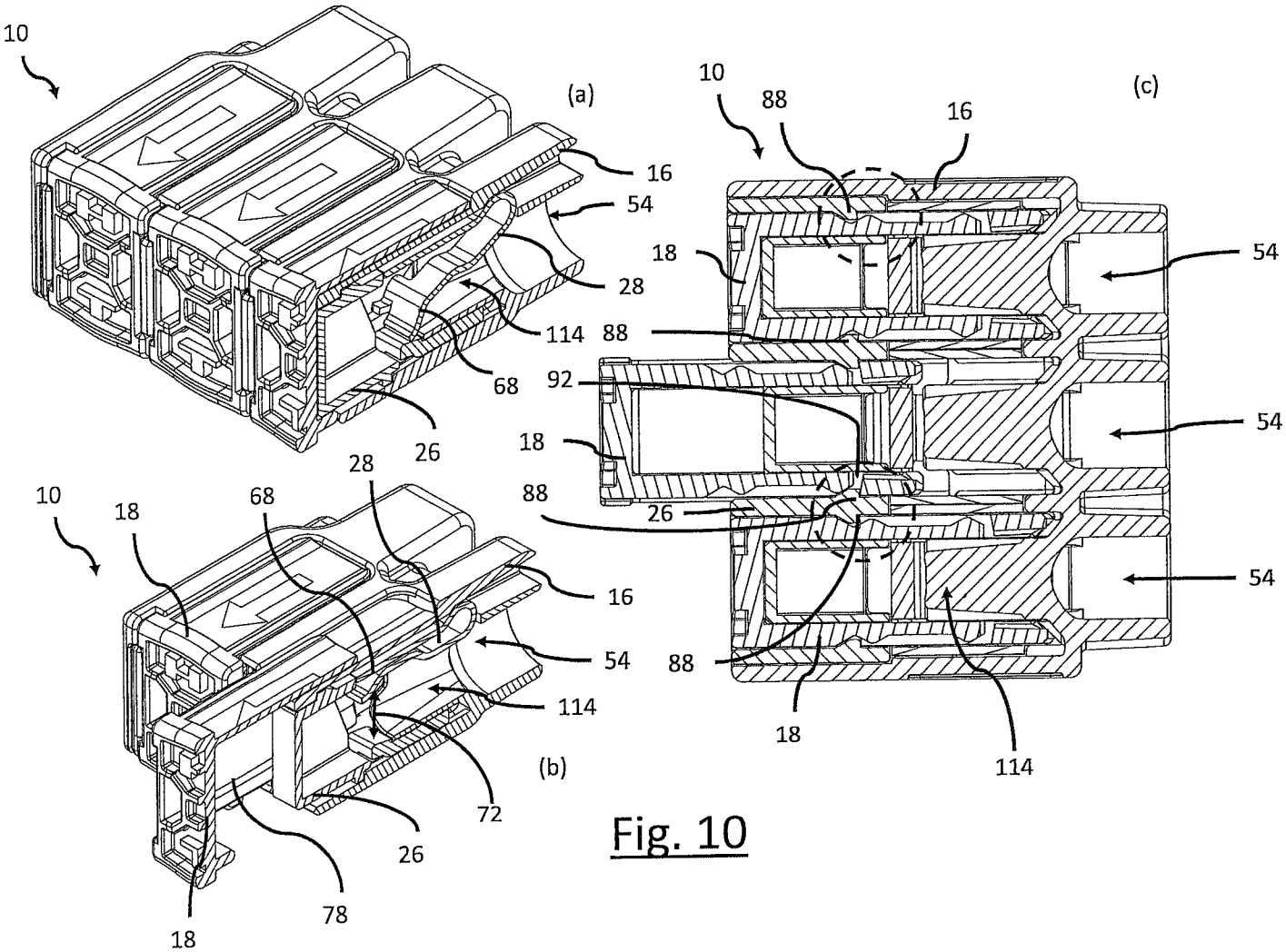
FIGS. 10*a*,10*b* show perspective cross-sectional views of the connector of FIG. 1 in different operational states.
FIG. 10*c* shows a cross-sectional top view of the connector of FIG. 1.

Each opening 54 communicates with a circular channel 114 which forms a guiding channel for the conductor 14 during insertion (cf. FIGS. 10*a*, 10*b*, and 10*c*). The channel 114 prevents the conductor 14 of slipping around the spring arm 28 when being introduced in the opening 54. The diameter of the channel 114 can be variable so as to improve guidance of the conductor 14 towards the free end 68 of the spring arm 28. The diameter of the channel can gradually and/or partially be reduced towards the ramp section 66 and the free end 68. The minimum diameter of the channel 114 can be smaller than a diameter of the opening 54 (FIGS. 10*a* and 10*b*). The inner shape of the channel 114 can be substantially circular, in particular oval. Similar shapes are possible.

FIG. 7*b* shows a cross-sectional view of the slider 18 and an adjacent portion of the outer housing element 16, wherein the cross-sectional plane is perpendicular to the plane indicated through the crosshatched areas in FIG. 7*c*. FIG. 7*b* will be explained further below.

As shown in FIG. 1, the slider 18 comprises an operating portion 58. The operating portion 58 comprises a press surface 62 extending substantially perpendicular to the second axis B. The press surface 62 preferably forms an outer side of the connector 10, wherein the outer side is preferably a narrow side of the connector 10. The press surface 62 has several openings 64 having different sizes. The openings 64 can be formed as recesses.

Further details of the bus bar 22 are described with reference to FIGS. 8*a* to 8*d*. FIG. 8*c* shows a cross-sectional view of the bus bar 22 of FIG. 8*b*, wherein the cross section is along the axis C shown in FIG. 8*b*. The bus bar 22 comprises ramp sections 66, wherein each ramp section 66 is associated with a free end 68 of the spring arm 28 of one of the clamps 24 mounted to the bus bar 22. Each ramp section 66 forms a contact portion for an electrical conductor 14, wherein the ramp section 66 is preferably inclined in the first direction dl in which the spring arm 28 can exert a force on the bus bar 22 when the spring arm 28 is in the connecting position (FIG. 6*a*, 6*b*).

Figure 9:
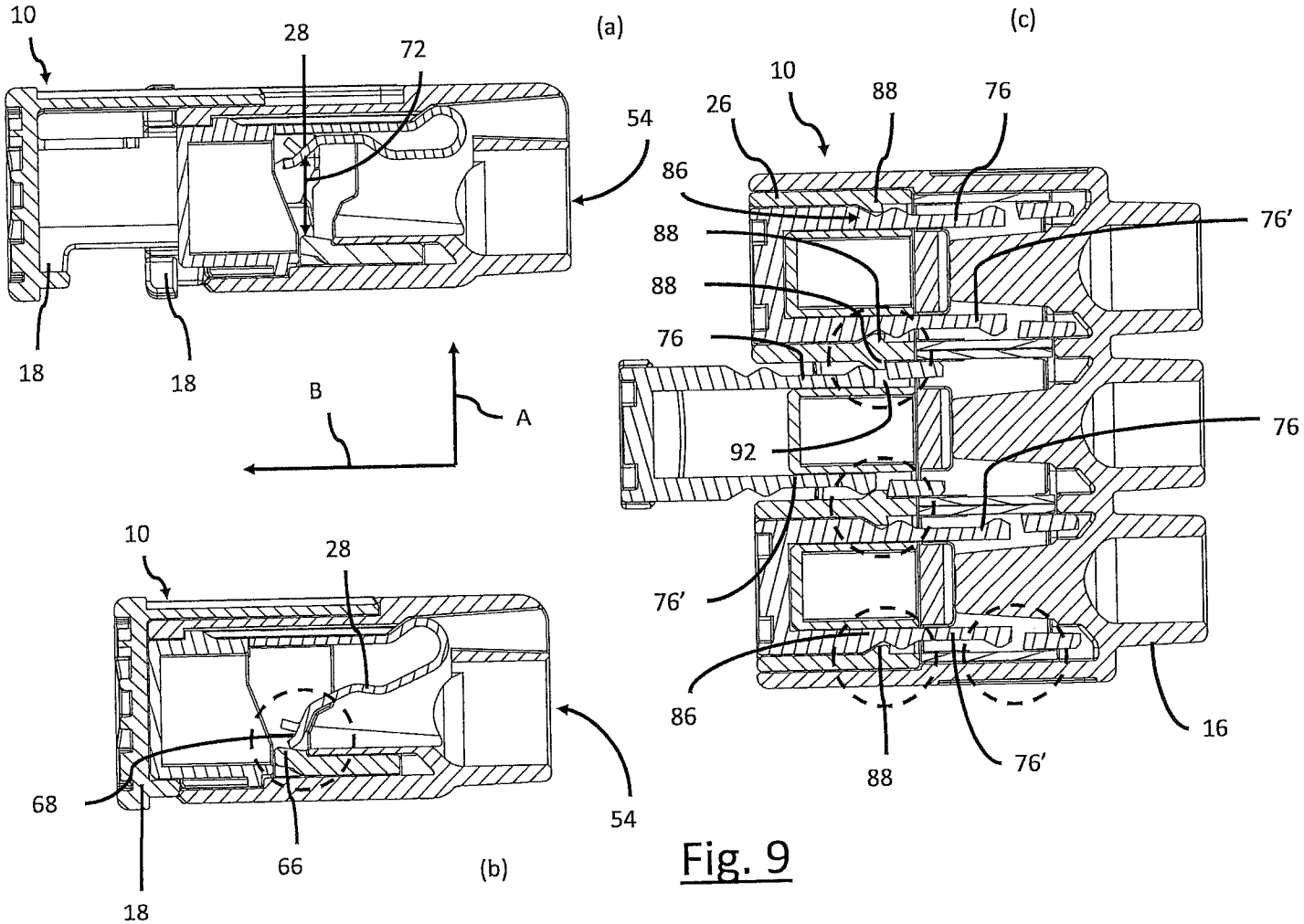
FIGS. 9*a*, 9*b* show cross-sectional side views of the connector of FIG. 1 in different operational states.
FIG. 9*c* shows a cross-sectional top view of the connector of FIG. 1.

The spring arm 28 cooperates with the bus bar 22 when the spring arm 28 is in the connecting position, as shown in FIGS. 8*a*, 9*b* and 10*a*. In particular, the free end 68 of the spring arm 28 rests on the associated ramp section 66 when the spring arm 28 is in the connecting position. When the spring arm 28 is in the connecting position, the slider 18 is in the closed position in which the slider 18 is preferably substantially received in the outer housing element 16.

In FIG. 9*a* and FIG. 10*b*, the spring arm 28 is positioned at a predetermined distance away from the bus bar 22. This is a disconnecting position of the spring arm 28, wherein an electrical conductor 14 can be inserted through the opening 54 of the outer housing element 16 into a gap 72 formed between the free end 68 of the spring arm 28 and the bus bar 22 or to be removed therefrom (FIG. 10*b*). The gap 72 can have a size of approximately 3 mm.

In order to move the spring arm 28 from the connecting position into the disconnecting position, the slider 18 is moved from the closed position into the open position in which the slider 18 preferably protrudes out of the outer housing element 16 as shown in FIG. 9*a* and FIG. 10*b*. In the open position, the slider 18 can protrude out of the outer housing element 16 by approximately 6 mm. The force necessary for moving the spring arm 28 is exerted via two opposite sliding guides 74 of the slider 18, wherein one of these sliding guides 74 is illustrated in the cross-sectional views of FIGS. 14, 15*a* (slider 18 in closed position) and 15*b* (slider 18 in open position). The sliding guides 74 are preferably generally identical. The sliding guides 74 cooperate with the spring arm 28 such that the movement of the slider 18 along the second axis B translates into the movement of the spring arm 28 along the first axis A, as illustrated by FIGS. 9*a*, 9*b*, 10*a*, 10*b*, 14, 15*a*, and 15*b*.

Figure 12:
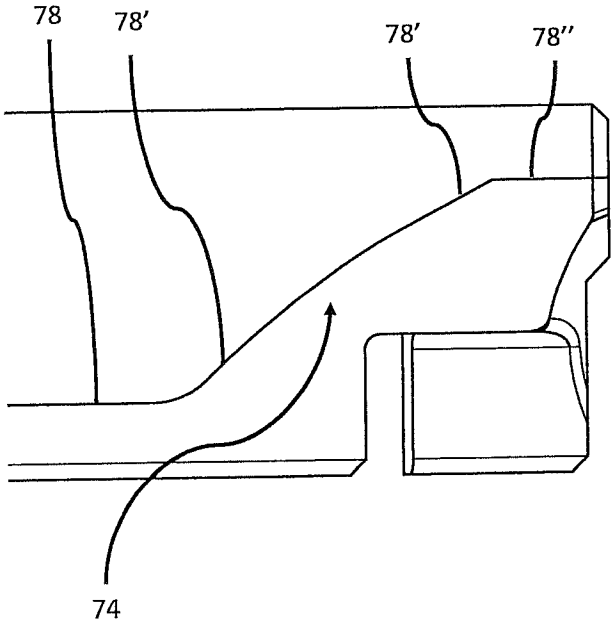
FIG. 12 schematically illustrates a sliding guide of a slider for the electrical connector of FIG. 1.
Figure 14:
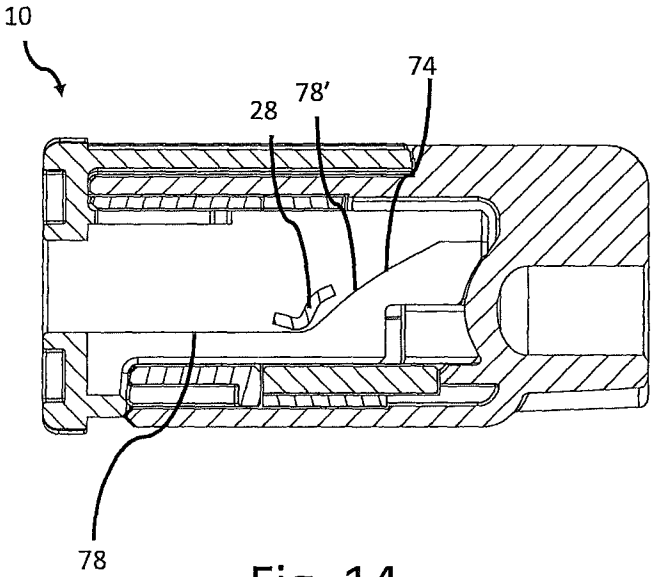
FIG. 14 shows a cross-sectional side view of the connector of FIG. 9*b*, wherein the cross-sectional plane is shifted compared to FIG. 9*b;*
Figure 15:
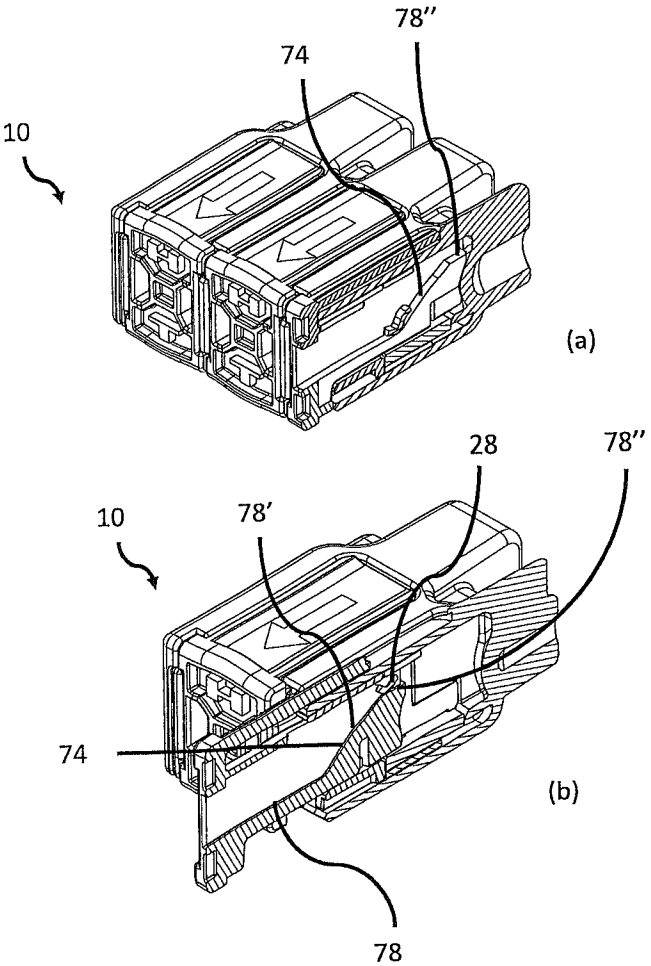
FIG. 15*a* shows a cross-sectional perspective side view of the connector of FIG. 9*b*, wherein the cross-sectional plane is shifted compared to FIG. 9*b;*
FIG. 15*b* shows a cross-sectional perspective side view of the connector of FIG. 9*a*, wherein the cross-sectional plane is shifted compared to FIG. 9*a;*

The sliding guides 74 are formed at two opposite side arms 76, 76' of the slider 18, wherein the side arms 76, 76' preferably extend parallel to the second axis B and grasp the clamp 24, as shown, e.g., in FIG. 9*c*. As mentioned above, in FIGS. 14, 15*a*, and 15*b* only one sliding guide 74 is visible. The sliding guide 74 preferably comprises three linear or curved segments 78, 78', 78", as shown in FIG. 12. As indicated in FIGS. 14 and 15*a*, the sliding guide 74 cooperates with the spring arm 28 at or close to a junction between segments 78 and 78' when the spring arm 28 is in the connecting position. As further shown in FIG. 15*b*, the sliding guide 74 cooperates with the spring arm 28 on segment 78" when the spring arm 28 is in the disconnecting position. Segments 78 and 78" are preferably parallel to the second axis B and can define maximum positions of the spring arm 28. When the slider 18 is in a position between the open and the closed position, the spring arm 28 cooperates with the sliding guide 74 on segment 78', which forms a ramp section of the sliding guide 74. The sliding guide 74 can be designed differently and can comprise for example non-linear portions as indicated for segment 78' in FIG. 12. It is also possible that the sliding guide 74 does not cooperate with the spring arm 28 when the spring arm 28 is in the connecting position. In this way, the spring arm 22 is free to cooperate with the bus bar 22. Preferably, the sliding guide 74 can lift the spring arm 28 in a direction against a restoring force of the spring arm 28, wherein the sliding guide 74 does not exert a force on the spring arm 28 in the opposite direction, i.e., a direction of pre-load of the spring arm 28.

The sliding guide 74 cooperates with a preferably convex support surface 82 of the spring arm 28 (FIG. 5*b*), wherein the support surface 82 is formed at a lateral tongue 84 bent away from the free end 68 of the spring arm 28. Preferably, the spring arm 28 comprises two opposite lateral tongues 84, 84', as shown in FIG. 5*b*, wherein each tongue 84, 84' forms a support surface 82 for an associated sliding guide 74 of the slider 18.

As can be seen, e.g., in FIG. 8*a*, the spring arm 28 is preferably bent away from the bus bar 22 at portion 108 substantially half-way between the resilient portion 32 and the free end 68. Furthermore, the spring arm 28 is preferably bent towards the bus bar 22 at portion 110. Therefore, an indentation 112 is formed at the spring arm 28 which, e.g., improves resilience of the spring arm 28. Furthermore, the segment between the portion 108 and the portion 110 can act as a stop surface for the spring arm 28 which can flatly engage with the frame portion 34 when the spring arm 28 is in the disconnecting position, thereby defining a maximum displacement of the spring arm 28 (FIGS. 9*a* and 5*b*).

For securing the slider 18 in the closed position, the slider 18 preferably comprises V-shaped recesses 86 which engage with preferably wedge-shaped projections 88 formed at the inner housing element 26 when the slider 18 is in the closed position (FIGS. 9*c* and 10*c*). The projections 88 can alternatively be formed at the outer housing element 16. In this way, the slider 18 latches to the housing of the connector 10 when the slider 18 is in the closed position. The recesses 86 and projections 88 form first locking members of the connector 10.

The connector 10 further comprises second locking members for securing the slider 18 in the open position. The second locking members are preferably formed by openings 92 of the slider 18 and the projections 88 of the inner housing element 26. The openings 92 and the projections 88 engage when the slider 18 is in the open position, wherein the slider 18 preferably cannot be moved further away from the outer housing element 16 (FIGS. 9*c* and 10*c*). For this purpose, the projection 88 and the engaging portion of the slider 18 adjacent to the opening 92 can be inclined so as to further improve locking of the slider 18 in the closed position. The skilled person will understand that other, additional or modified means of mechanical locking, i.e. latching can be provided.

As shown for example in FIGS. 1 and 7*a*, the outer housing element 16 can comprise two opposite recesses 94 arranged adjacent to the openings 54 of the outer housing element 16 on two opposite narrow sides that extend parallel to the second axis B. Further recesses 96 (cuttings) can be provided on the top side (FIG. 1).

Figure 11:
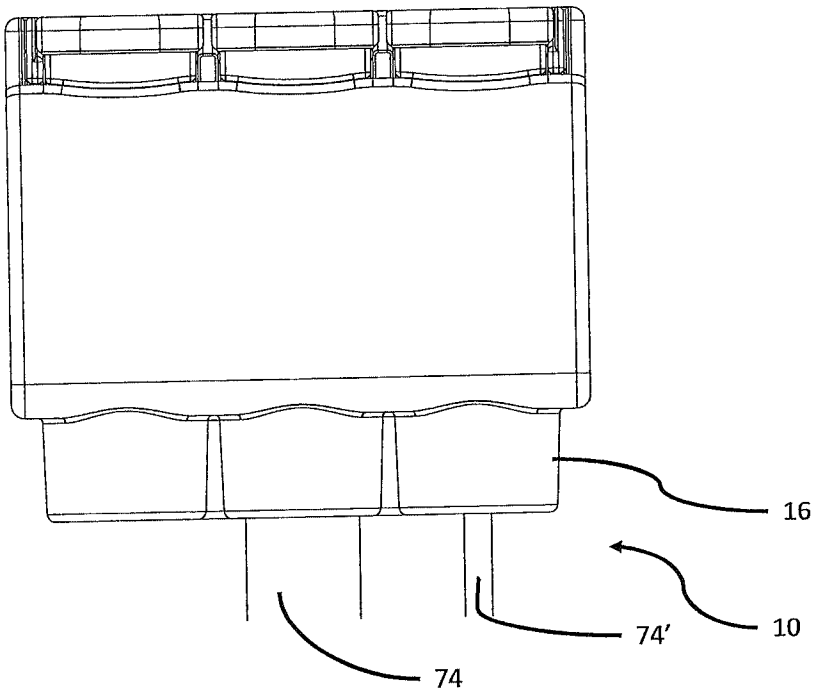
FIG. 11 shows a top view of the connector of FIG. 1.
Figure 16:
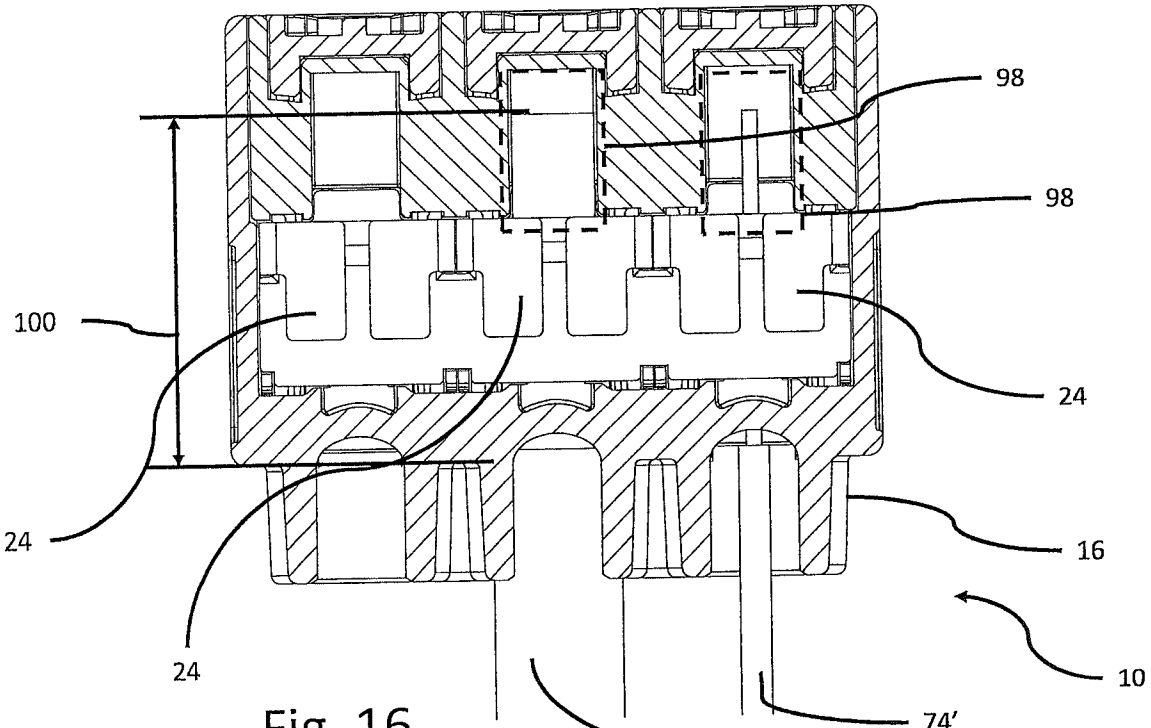
FIG. 16 shows a cross-sectional top view of the connector of FIG. 11.

With reference to FIGS. 11 and 16, wherein FIG. 16 is a cross-sectional view of the connector 10 of FIG. 11, the outer housing element 16 preferably comprises control windows 98, wherein the position of an end section of an electrical conductor 14, 14' can be monitored from outside the outer housing element 16. In this way, the user can check whether the conductor 14, 14 is passed through the corresponding clamp 24 so that the spring arm 28 can be moved into the connecting position thereby securing the conductor 14, 14' to the bus bar 22. The control windows 98 do not need to be formed separately if the corresponding housing portions are formed of a transparent material. In the embodiment shown in FIG. 11, the inner housing element 26 and the outer housing element 16 are formed by a transparent material. A distance 100 shown in FIG. 11 can be approximately 11 mm.

With reference to FIG. 1, the operating portion 58 of the slider 18 can comprise two ridges 101 arranged on opposite sides of the operating portion 58, wherein each of the two ridges 101 projects outwardly away from the slider 18 and extends substantially perpendicular to the second axis B. The operating portion 58 of the slider 18 further comprises a support surface 102 extending substantially perpendicular to the plane defined by the first axis A and the second axis B, wherein the support surface 102 forms a first outer side of the connector 10, and wherein one of the ridges 101 is arranged adjacent to the support surface 102. The support surface 102 is preferably guided in the outer housing element 16 so that a force exerted onto the support surface 102 is compensated by the outer housing element 16 (FIG. 7*b*). For this purpose, the outer housing element 16 preferably has a convex surface 104 arranged between the lateral edges of the slider 18 which preferably have further convex surfaces 106 for lowering sliding resistance when a force is exerted onto the support surface 102. The support surface 102 can be recessed as shown in FIGS. 1 and 7*a* so as to further improve support for the user.

As is also shown in FIG. 7*b*, a recess 56' is provided in the outer housing element 16 for latching the outer housing element 16 to the inner housing element 26.

The connector 10 of FIG. 1 has a height of 8.3 mm, a width of 18.6 mm and a length of 18.7 mm. The connector 10 is thus very compact. However, the connector 10 can also have other dimensions.

The preceding description is exemplary rather than limiting in nature. Variations and modifications to the disclosed examples may become apparent to those skilled in the art that do not necessary depart from the essence of this invention. The scope of legal protection given to this invention can only be determined by studying the following claims.

The invention claimed is:

1. An electrical connector for receiving at least one electrical conductor, the connector comprising:

a housing;

a bus bar arranged inside the housing;

at least one clamp arranged inside the housing; and at least one slider;

wherein the at least one clamp comprises a spring arm moveable relative to the bus bar along a first axis between a connecting position and a disconnecting position;

wherein the spring arm cooperates with the bus bar to secure the electrical conductor to the bus bar when the spring arm is in the connecting position;

wherein the spring arm is positioned at a predetermined distance away from the bus bar when the spring arm is in the disconnecting position, thereby allowing an end section of the electrical conductor to be inserted through an opening of the housing into a gap between the spring arm and the bus bar or to be removed from the gap;

wherein the at least one slider extends into the housing and is moveable relative to the housing along a second axis between a closed position and an open position;

wherein the at least one slider includes two opposite sliding guides cooperating with a convex support surface of the spring arm such that a movement of the slider translates into a movement of the spring arm along the first axis;

wherein the sliding guides are formed at two opposite side arms of the slider, said side arms extending parallel to the second axis;

wherein the spring arm comprises two opposite lateral tongues bent away from a free end of the spring arm, each tongue forming the convex support surface for cooperation with a respective one of the sliding guide of the slider.

2. The electrical connector according to claim 1, wherein the spring arm is in the connecting position when the slider is in the closed position, and wherein the spring arm is in the disconnecting position when the slider is in the open position.

3. The electrical connector according to claim 1, wherein the slider is fully accommodated in the housing and substantially flush with the housing when the slider is in the closed position.

4. The electrical connector according to claim 1, wherein the first axis and the second axis are substantially perpendicular to each other.

5. The electrical connector according to claim 1, wherein the housing comprises a first outer side and an opposite second outer side, the first outer side and the second outer side both being substantially perpendicular to the second axis, wherein the first outer side comprises an opening for inserting the electrical conductor into the housing, and wherein the slider extends into the housing through the second outer side.

6. The electrical connector according to claim 1, wherein the housing comprises at least two outer recesses arranged on opposite sides of the housing, respectively, wherein the opposite sides are narrow sides of the housing.

7. The electrical connector according to claim 1, wherein the housing comprises at least one control window arranged such that a position of the electrical conductor inserted into the housing is visible from outside the housing.

8. The electrical connector according to claim 1, wherein the housing comprises an outer housing element and an inner housing element, wherein the inner housing element is arranged inside the outer housing element, and wherein at least one of the bus bar and the at least one clamp are secured in the housing by means of the inner housing element.

9. The electrical connector according to claim 1, wherein the at least one clamp is directly mounted to the bus bar.

10. An electrical connector according to claim 1, wherein the at least one clamp is latched to the bus bar, wherein the bus bar is caught clamped in at least one integral mounting section of the at least one clamp, wherein the at least one mounting section is formed by a support arm and a locking arm, and wherein the bus bar extends between the support arm and the locking arm.

11. An electrical connector according to claim 1, wherein the at least one clamp comprises two mounting sections arranged on two opposite sides of the spring arm, wherein the bus bar comprises at least one recess defining a position at which the at least one clamp is mounted to the bus bar.

12. An electrical connector according to claim 1, the bus bar comprises at least one ramp section associated with a free end of the spring arm, wherein the ramp section forms a contact portion for an electrical conductor, wherein the free end of the spring arm comprises a contact edge facing the ramp section of the bus bar, wherein the spring arm comprises a base portion which is integrally connected to a frame portion of the at least one clamp, and wherein the spring arm further comprises an extension portion which is integrally connected to the frame portion opposite from the base portion.

13. An electrical connector according to claim 1, wherein the bus bar is at least partially flush with the at least one clamp.

14. An electrical connector according to claim 1, wherein the at least one clamp is mounted to the bus bar in a first direction, wherein the spring arm exerts a force on the bus bar in a second direction when the spring arm is in the connecting position, and wherein the first and second directions are substantially the same or substantially opposite, wherein the bus bar comprises at least one ramp section associated with a free end of the spring arm, wherein the ramp section forms a contact portion for an electrical conductor, and wherein the ramp section is inclined in the first direction.

15. The electrical connector according to claim 1, further comprising at least one first locking member for securing the slider in the closed position relative to the housing.

16. The electrical connector according claim 15, further comprising at least one second locking member for securing the slider in the open position relative to the housing.

17. The electrical connector according to claim 1, wherein the slider comprises an operating portion with at least two ridges arranged on opposite sides of the operating portion, wherein each of the two ridges projects outwardly away from the connector and extends substantially perpendicular to the second axis.

18. The electrical connector according to claim 17, wherein the operating portion comprises a support surface extending substantially parallel to the second axis, wherein the support surface forms a first outer side of the connector, and wherein one of the ridges is arranged adjacent to the support surface.

19. The electrical connector according to claim 17, wherein the operating portion comprises a press surface extending substantially perpendicular to the second axis, wherein the press surface forms a second outer side of the connector.

* * * * *